United States Patent [19]

Hicklin et al.

[11] 4,074,393

[45] Feb. 21, 1978

[54] METHOD AND APPARATUS FOR DRY FORMING A LAYER OF FIBERS

[75] Inventors: Denis Raymond Hicklin, Bath; Brian William Attwood, Bristol, both of England

[73] Assignee: Karl Kroyer St. Anne's Limited, Bristol, England

[21] Appl. No.: 640,219

[22] Filed: Dec. 12, 1975

[30] Foreign Application Priority Data

Jan. 18, 1975 United Kingdom ..... 02251/75

[51] Int. Cl.[2] ..... D04H 1/00

[52] U.S. Cl. ..... 19/303

[58] Field of Search ..... 19/155, 156–156.4, 19/144, 148; 156/62.2, 62.4, 62.8; 425/80, 81

[56] References Cited

U.S. PATENT DOCUMENTS

| | | | |
|---|---|---|---|
| 1,827,858 | 10/1931 | Tannery | 19/144 |
| 2,116,663 | 5/1938 | Powell | 19/156 X |
| 2,743,758 | 5/1956 | Uschmann | 19/156 X |
| 2,912,723 | 11/1959 | Roberts | 19/156.3 |
| 2,940,133 | 6/1960 | Heritage | 19/156.3 X |
| 2,940,134 | 6/1960 | Heritage | 19/156.4 X |
| 3,071,822 | 1/1963 | Meiler | 19/156.3 |
| 3,423,796 | 1/1969 | Nordstrand | 19/156.3 |

FOREIGN PATENT DOCUMENTS

| | | | |
|---|---|---|---|
| 1,207,556 | 10/1970 | United Kingdom | 19/144 |

*Primary Examiner*—Dorsey Newton

*Attorney, Agent, or Firm*—Larson, Taylor and Hinds

[57] ABSTRACT

In dry forming a layer of fibers, the fibers are conveyed by carrier air to a distributor housing having a perforated bottom wall through which the fibers pass downwards on to a foraminous forming surface connected on its underside to a suction box. The invention ensures that the fibers pass from the distributor to the forming surface under the influence of suction and gravity alone so as to provide a layer of more uniform depth than hitherto obtained by dry forming.

11 Claims, 7 Drawing Figures

METHOD AND APPARATUS FOR DRY FORMING A LAYER OF FIBERS

Figure 1:
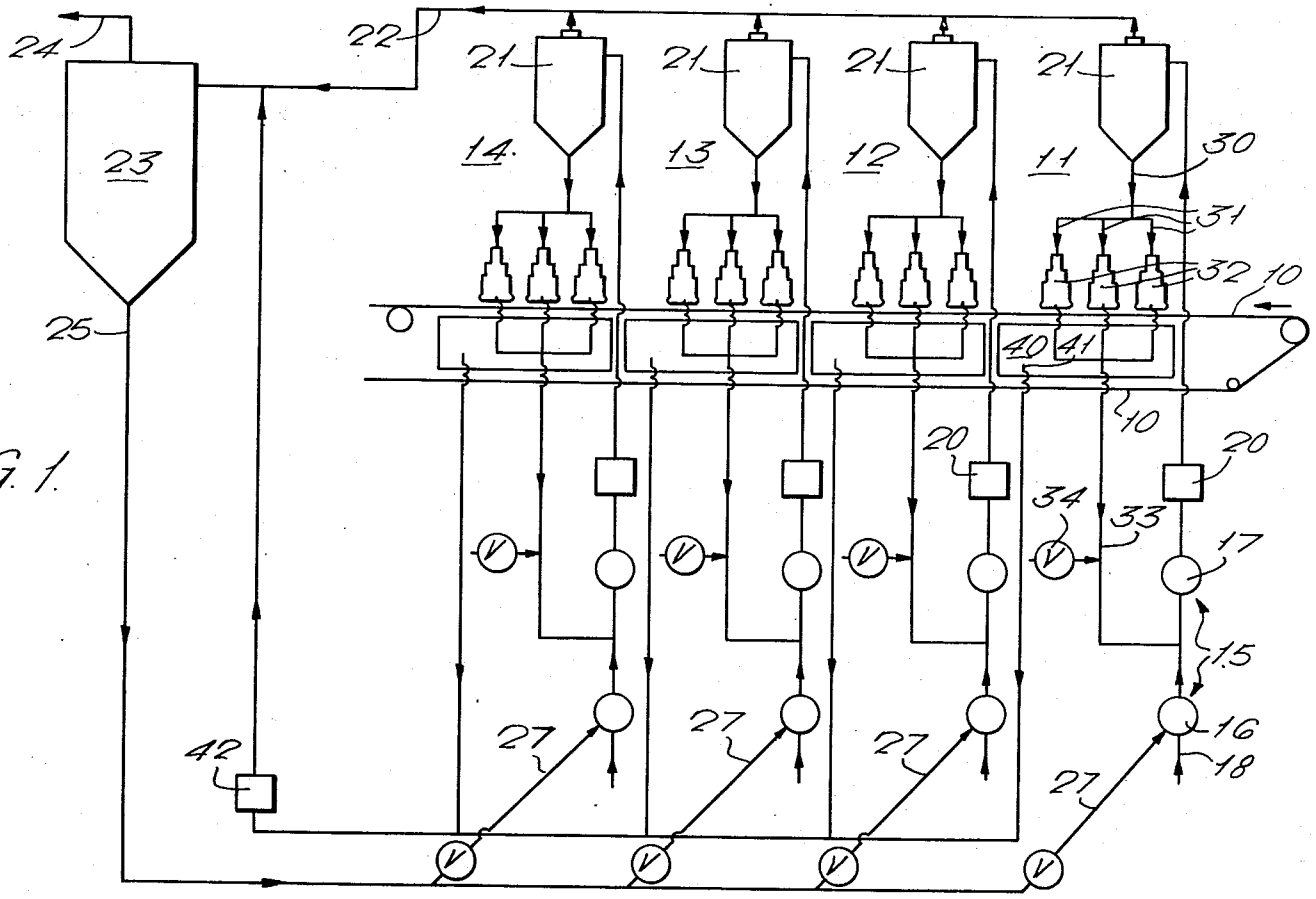

This invention relates to a method and apparatus for dry forming a layer of fibers on a forming surface.

In a typical method of dry forming a fibrous layer, dry fibrous raw material, e.g. wood cellulose, which has been disintegrated in a hammer mill into discrete fibers is conveyed in a stream of carrier air to be laid on a foraminous forming surface, suction being applied to the underside of the forming surface to assist in the formation of the fibrous layer. The latter is sprayed with a binder, e.g. water, and then consolidated by heat and pressure for producing paper or board. If desired, suitable additives may be incorporated to produce a so-called non-woven product.

It is known to provide a distributor above the forming surface which receives a stream of fiber-laden carrier air and comprises a cylindrical housing having a closed top and a perforated flat bottom wall, a side inlet for the carrier air, and plurality of side-by-side impellers which rotate about vertical axes. The impellers which are located a short distance above the bottom wall are provided to agitate and distribute the fibers across the bottom wall and to disintegrate clots of fibers which may occur. Clots which are not disintegrated are urged towards the housing side wall where an air jet blows them out of the housing through a slit provided for that purpose in the side wall. The fibers and their carrier air escape through the bottom wall to be sucked down on to the foraminous forming surface by means of a suction box below the forming surface.

It has been found that the escape of all or most of the carrier air through the perforated bottom wall can seriously militate against the formation of a layer of uniform depth on the forming surface. This is especially so if the carrier air is also initially required to cool a hammer mill or other plant and requires to have a minimum rate of flow which results in a correspondingly high rate of flow to the distributor and through the bottom wall of the distributor housing. The present invention avoids this disadvantage.

According to one aspect of the invention, a method of dry forming a layer of fibers comprises the steps of (a) conveying discrete fibers in a stream of carrier air to an inlet of a distributor housing, (b) agitating the fibers to form a bed of fibers across a perforated bottom wall of the housing, (c) and sucking fibers from the bed downwards through the bottom wall and on to a foraminous forming surface to form a layer thereon, (d) characterised in that at least most of the carrier air which enters the housing escapes from a part of the housing which is above the bed of fibers, whereby the fibers pass from the bottom wall of the housing to the forming surface under the influence of suction and gravity alone.

According to another aspect of the invention, apparatus for dry forming a layer of fibers comprises (a) a distributor housing having an inlet for carrier air laden with discrete fibers and a perforated bottom wall, (b) means within the housing for agitating discrete fibers to form a bed of fibers across the bottom wall, (c) a foraminous forming surface immediately below the bottom wall, (d) and a suction box connecting with the underside of the forming surface, (e) wherein a cooling and feed system is connected to the housing inlet comprising means for generating and utilising a stream of air to cool plant included in the system and means for thereafter conveying the stream of air as carrier air for discrete fibers to the housing inlet, (f) which housing is provided with an opening above the bed of fibers for the escape of at least most of the carrier air to allow the fibers to pass from the bottom wall of the housing to the forming surface under the influence of suction and gravity alone.

Figure 2:
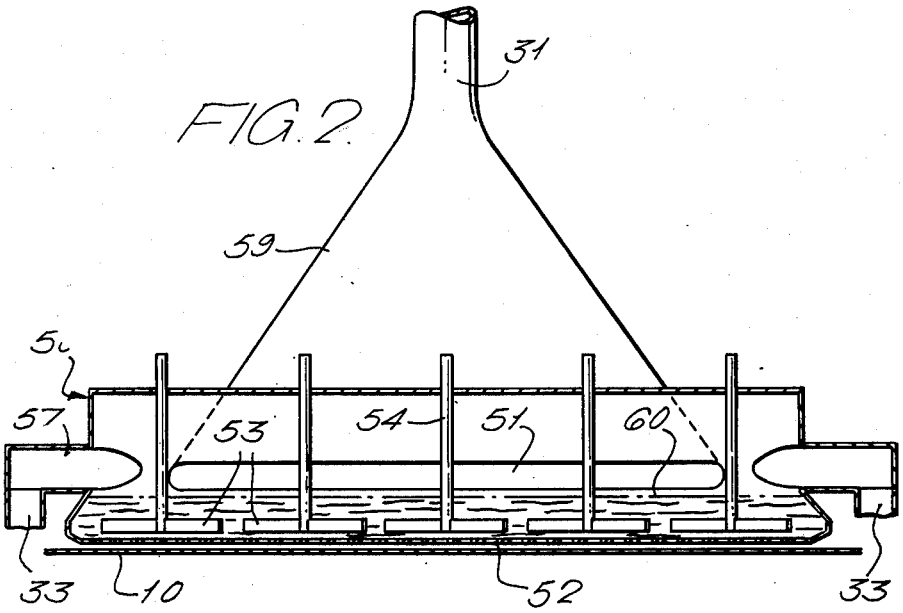
Figure 3:
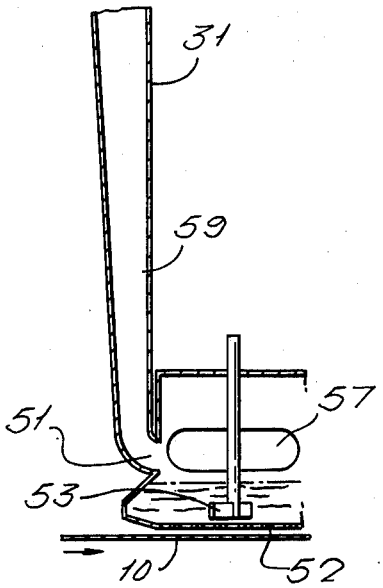
Figure 4:
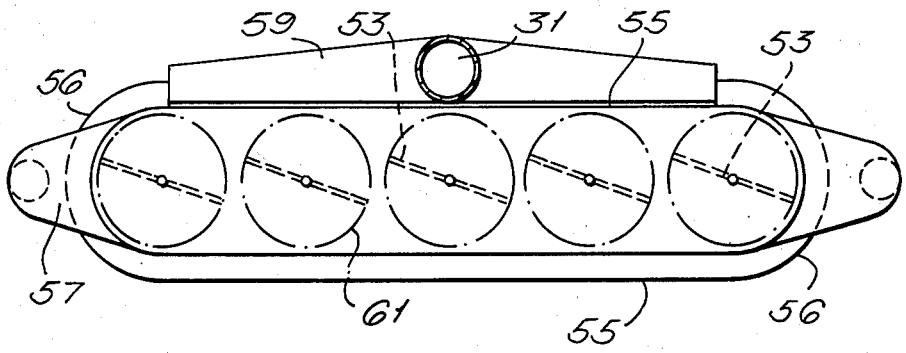
Figure 5:
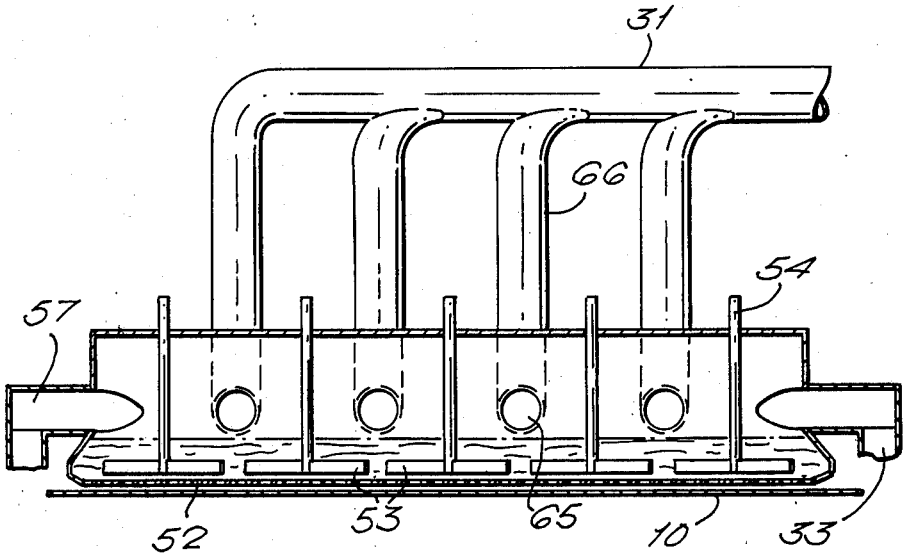
Figure 6:
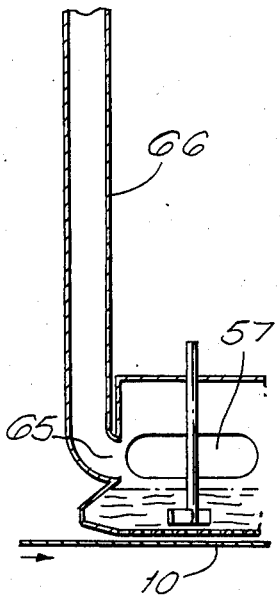
Figure 7:
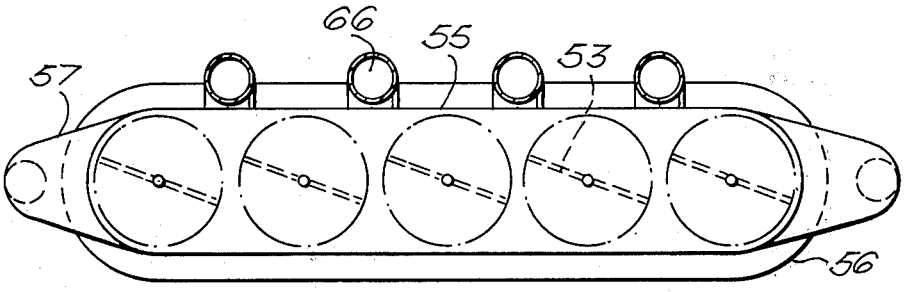

By way of example the invention will now be described with reference to the accompanying diagrammatic drawings of which, FIG. 1 shows a fiber feed and recycling system including a number of fiber distributors for dry forming a layer of fibers, FIGS. 2, 3 and 4 are respectively a vertical section, end view and plan of one form of distributor, and, FIGS. 5, 6 and 7 are respectively a vertical section, end view and plan of another form of distributor.

Referring to FIG. 1, there is shown a foraminous forming surface 10 on the upper surface of which is to be deposited dry fibers to form a dry fibrous layer of material. The forming surface 10 is a travelling endless wire belt. Four plys or layers are deposited from first ply apparatus 11, second ply apparatus 12, third ply apparatus 13 and fourth ply apparatus 14. The apparatus for each ply is identical to the other and one such ply apparatus namely number 11 will be described hereafter.

Apparatus 11 for depositing the first ply comprises disintegrating and defibrating equipment 15 comprising a bale breaker 16 and an air-cooled hammer mill 17. Bales of fiber are fed to the bale breaker 16 from a source at 18 and the broken bales are fed to the hammer mill 17 from which the individual fibers are carried by a stream of carrier air generated by a fan 20 to a cyclone separator 21 in which some of the air is separated from the fibers and conveyed via a duct 22 to a further cyclone separator 23. The stream of carrier air is initially used to flow through and cool the hammer mill 17 whose high energy operation demands such cooling. The air passing through duct 22 will still contain fibers and these fibers are separated in the cyclone separator 23, the air passing to atmosphere at a vent 24 whilst the fibers pass through duct 25 and valve-controlled ducts 27 to the fiber feed system, for example to bale breaker 16 but preferably to the apparatus 12 or 13 which will provide the middle plies of the multi-ply final product. It will be noted that the cyclone separator 23 is common to all four ply systems as is the fiber-laden carrier air duct 22 and the return duct 25.

The more concentrated fiber-air mixture leaving the cyclone separator 21 passes through ducts 30, 31 to a fiber distributor system which in this embodiment comprises three fiber distributors 32 mounted immediately above the wire belt 10. Fiber from the distributors 32 is deposited on to the forming surface 10 to form the first ply of a multi-ply product.

Excess fiber fed to the distributors 32 and not deposited on the forming surface 10 is withdrawn through ducts 33 arranged to communicate with the air flow through the hammer mill 17 so as to provide an induced suction in the ducts 33.

Should extra air be required at the disintegrating and defibrating equipment in order to balance the closed system so far described, it can be taken in to the duct 33 as indicated at 34 to mix with any excess fibers being returned from the distributors 32.

Disposed immediately below the forming surface 10 and common to the distributors 32 is a suction box 40 for drawing fibers from the distributors down on to the forming surface 10 to form a layer thereon. Any fibers which pass through the forming surface 10 enter the box 40 and are conveyed by carrier air in duct 41 and fan 42 to the cyclone separator 23. Here the fibers and air from the suction box 40 mix with the air fibers from the cyclone separator 21, the excess air is removed through the duct 24, and the fibers are recycled via the ducts 25, 27 to the second and third ply apparatus.

Referring to FIGS. 2–4, a fiber distributor comprises an elongate housing 50 having an elongate horizontal slot in a wall 55 of the housing which forms an inlet 51 for fiber-laden carrier air, a perforated flat bottom wall 52 through which fibers are sucked down on to the forming surface 10 below, and a linear series of agitators 53 comprising rotor arms mounted on the lower ends of vertical drive shafts 54.

The housing 50 comprises two parallel walls 55 joined at their ends by two outwardly curved end walls 56. The four walls 55, 56 diverge outwards adjacent the bottom wall 52. The end walls are provided with outlet slots 57 connecting with two ducts 33 for the removal and recycling of excess fibers. A duct 31 connects via a fish-tail duct 59 with the inlet 51. The top of the housing 50 is open for the escape of carrier air but is provided with a gauze screen or the like (not shown) for preventing upward escape of fibers. The operation of the agitators 53 produces an agitated bed of fibers 60 which envelops the rotor arms, the maximum depth of the bed being limited by the height of the slots 57 above the bottom wall 52.

The upper ends of the rotor shafts 54 project out of the housing to be connected to one or more motors (not shown). The agitators each sweep a circular path 61 of 15″–30″ diameter while rotating at a speed of 700–2000 rpm. The areas swept by adjacent agitators are close to one another, each swept area also being close to adjacent walls of the housing. In this manner the unswept areas are kept small and build-up of any fiber clots on the walls is minimised.

In operation a stream of air which is used to cool the hammer mill 17 and therefore has a correspondingly high rate of flow is further utilised as carrier air to convey discrete fibers via a separator 21 to the distributor inlet 51. The passage of the carrier air through the divergent duct 59 results in some reduction of its rate of flow but the rate of flow at the inlet 51 is still appreciably higher than would normally be used for conveying purposes only. The fiber-laden carrier air enters the housing in the form of a lateral sheet-like discharge which is substantially parallel to and above the bed 60 produced by the rotating agitators 53. The provision of the quickly formed bed 60 (which has a depth of several inches) and the open top of the housing 50 ensure that at least most of the carrier air escapes upwards out of the housing leaving its fibers to join the bed. The operation of the suction box 40 beneath the bottom wall 52 sucks fibers from the bed 60 downwards through the wall 52 and on to the moving forming surface 10 to form a layer thereon. As a result the fibers from the bottom wall are dry laid on the forming surface 10 under the influence of suction and gravity alone, i.e. without distortion of the layer profile by passage of a flow of carrier air through the bottom wall 52.

Any suitable arrangement and construction of agitators 53 may be employed. For example, adjacent agitators may have overlapping rotor arms to reduce the amount of unswept area between then.

Referring to FIGS. 5–7, the construction and operation of an alternative form of distributor are generally similar to those described above with reference to FIGS. 2–4 and corresponding parts carry the same reference numerals. The main differences of construction are that the single side inlet 51 is replaced by four circular side inlets 65 each of which is fed by a separate tapping 66 from a common supply duct 31.

What we claim is:

1. A method of dry forming a layer of fibers comprising the steps of conveying discrete fibers in a stream of carrier air to an inlet of a distributor housing having a fixed, perforated, bottom wall and having carrier air outlet means located above said bottom wall comprising an outlet open to atmosphere and an outlet for the removal of excess fibers; agitating the fibers to form a bed of fibers across and on top of said perforated bottom wall of the housing, said bed of fibers being formed below said carrier air outlet; and sucking fibers from the bed downwards through the bottom wall and onto a moving foraminous forming surface positioned immediately below said perforated bottom wall to form a layer of said fibers on said moving foraminous surface, whereby at least most of the carrier air which enters the housing escapes through said carrier air outlet means above the bed of fibers, and whereby the fibers pass from the bed through the fixed bottom wall of the housing to the moving forming surface under the influence of suction and gravity alone.

2. A method according to claim 1, wherein the carrier air is used for cooling purposes before entering the distributor housing and has a consequent rate of flow to the housing inlet which is in excess of that required for conveying the fibers to the housing inlet.

3. A method according to claim 1, wherein the carrier air before entering the distributor housing is used to cool a hammer mill for producing said discrete fibers.

4. A method according to claim 1, wherein said carrier air outlet comprises an opening in the top of the distributor housing.

5. A method according to claim 1, wherein the carrier air enters the distributor housing as a lateral sheet-like discharge substantially parallel to and above the bed of fibers.

6. A method according to claim 1 wherein said carrier air outlet comprises an opening in the top of said distributor housing and an opening in the side wall of said distributor housing and in which carrier air is removed through said openings.

7. A method according to claim 6 wherein suction is applied to said opening in the side wall of said distributor housing to remove carrier air from said distributor housing.

8. Apparatus for dry forming a layer of fibers comprising a distributor housing having an inlet for carrier air laden with discrete fibers, a fixed, perforated bottom wall and carrier air outlet means located above said bottom wall; means within the housing for agitating discrete fibers to form a bed of fibers across and on top of the bottom wall and below said carrier air outlet; said carrier air outlet means including an outlet open to atmosphere and an outlet for the removal of excess fibers from the housing to limit the maximum depth of the bed of fibers; a moveable foraminous forming surface immediately below the bottom wall; means for moving said movable foraminous surface in a path below said bottom wall; a suction box connecting with the underside of said moving forming surface; a cooling and fiber feed system connected to the distributor housing inlet and comprising an air cooled plant utilizing a flow of coolant air in excess of that required for conveying the fibers to the distributor housing inlet, said system further comprising means for generating said flow of coolant air and means for utilizing said flow of coolant air as carrier air for conveying said fibers to the distributor housing inlet; said carrier air outlet means permitting escape of at least most of the carrier air from said distributor housing whereby said fibers are allowed to pass through said fixed, perforated bottom wall to said moveable foraminous forming surface under the influence of suction and gravity alone.

9. Apparatus according to claim 8, wherein the agitating means comprises a linear series of agitators having rotor arms arranged to sweep circular paths across and above said fixed, perforated bottom wall.

10. Apparatus according to claim 8 wherein said carrier air outlet means comprises an opening in the top of said distributor housing and an opening in the side wall of said distributor housing.

11. Apparatus according to claim 10 further comprising suction means for applying suction to said opening in said side wall to remove carrier air therethrough.

* * * * *